US012317917B2

(12) United States Patent
Arredondo

(10) Patent No.: US 12,317,917 B2
(45) Date of Patent: Jun. 3, 2025

(54) WEB OF TIPPING PAPER

(71) Applicant: British American Tobacco Mexico, S.A. DE C.V., Nuevo Leon (MX)

(72) Inventor: Lucio Arredondo, Nuevo Leon (MX)

(73) Assignee: BRITISH AMERICAN TOBACCO MEXICO, S.A. DE C.V., Nuevo Leon (MX)

( * ) Notice: Subject to any disclaimer, the term of this patent is extended or adjusted under 35 U.S.C. 154(b) by 39 days.

(21) Appl. No.: 18/233,408

(22) Filed: Aug. 14, 2023

(65) Prior Publication Data

US 2023/0380479 A1 Nov. 30, 2023

Related U.S. Application Data

(62) Division of application No. 17/220,231, filed on Apr. 1, 2021, now abandoned, which is a division of (Continued)

(51) Int. Cl.
*A24C 5/47* (2006.01)
*A24C 5/58* (2006.01)

(Continued)

(52) U.S. Cl.
CPC ..... *A24C 5/473* (2013.01); *A24C 5/471* (2013.01); *A24C 5/586* (2013.01); *A24D 1/02* (2013.01);

(Continued)

(58) Field of Classification Search
CPC ..... A24C 5/473; A24D 3/04
See application file for complete search history.

(56) References Cited

U.S. PATENT DOCUMENTS 2,740,409 A * 4/1956 Korber ..... A24C 5/475 131/94
4,040,430 A 8/1977 Molins (Continued)

FOREIGN PATENT DOCUMENTS

EP 0574205 A1 12/1993
EP 1527898 A1 5/2005

(Continued)

OTHER PUBLICATIONS

Demand for International Preliminary Examination for International (PCT) Patent Application No. PCT/GB2015/052824; Dated Oct. 13, 2016.

(Continued)

*Primary Examiner* — Russell E Sparks
(74) *Attorney, Agent, or Firm* — CANTOR COLBURN LLP

(57) ABSTRACT

A method of manufacturing smoking articles including supplying a smoking article manufacturing machine with dual length filter rods, each dual length filter rod containing a first and a second type of capsule, using the machine to cut patches of tipping paper from a web, using the machine to wrap one of the patches about each dual length filter, and using the machine to cut each wrapped dual length filter rod to form first and second smoking articles, each having first and second filter rod segments, where the first filter rod segment includes the first type of capsule and the second filter rod segment includes the second type of capsule, where the web includes first and second lateral portions, the first lateral portion having different visual or tactile mark or indicia than the second lateral portion.

1 Claim, 8 Drawing Sheets

Related U.S. Application Data application No. 15/764,392, filed as application No. PCT/GB2015/052824 on Sep. 29, 2015, now abandoned.

(51) Int. Cl.

| | |
|---|---|
| ***A24D 1/02*** | (2006.01) |
| ***A24D 1/04*** | (2006.01) |
| ***A24D 3/02*** | (2006.01) |
| ***A24D 3/04*** | (2006.01) |

(52) U.S. Cl.

CPC ..... *A24D 1/045* (2013.01); *A24D 3/0216* (2013.01); *A24D 3/0287* (2013.01); *A24D 3/04* (2013.01)

(56) References Cited

U.S. PATENT DOCUMENTS

| | | | | |
|---|---|---|---|---|
| 4,527,570 | A * | 7/1985 | Porenski ..... | A24C 5/471 131/94 |
| 7,580,137 | B2 | 8/2009 | Wilson | |
| 8,944,075 | B2 | 2/2015 | Holford | |
| 2008/0230079 | A1* | 9/2008 | Besso ..... | A24D 3/048 131/274 |
| 2013/0180537 | A1 | 7/2013 | Cunningham | |
| 2016/0081394 | A1 | 3/2016 | Alarcon | |

FOREIGN PATENT DOCUMENTS

| | | | |
|---|---|---|---|
| GB | 2455733 | A | 6/2009 |
| WO | 2014132180 | A1 | 9/2014 |
| WO | 2016143128 | A1 | 9/2016 |

OTHER PUBLICATIONS

International Preliminary Report on Patentability for corresponding application PCT/GB2015/052824 filed Sep. 29, 2015.

International Search Report for corresponding application PCT/GB2015/052824 filed Sep. 29, 2015; Mail date Jun. 23, 2016.

Written Opinion for corresponding application PCT/GB2015/052824 filed Sep. 29, 2015; Mail date Jun. 23, 2016.

* cited by examiner

WEB OF TIPPING PAPER

CROSS REFERENCE TO RELATED APPLICATIONS

This application is a divisional of U.S. patent application Ser. No. 17/220,231 which was filed on Apr. 1, 2021 as a divisional of U.S. patent application Ser. No. 15/764,392 which was filed on Mar. 29, 2018 under 35 U.S.C. 371 as the U.S. national stage of International Patent Application Number PCT/GB2015/052824 filed on Sep. 29, 2015, the contents of all of said prior applications are incorporated herein by reference in their entirety.

TECHNICAL FIELD

The present disclosure relates to a web of tipping paper for use in manufacturing tobacco industry products on a tobacco industry machine. The tobacco industry products are smoking articles or more specifically, filter cigarettes, in which the filter rod of each cigarette contains an object, such as a capsule, which has been inserted into the filter rod using a filter rod making machine. A method of using the tipping paper in the concurrent manufacture of two different types of smoking article on a smoking article manufacturing machine is also disclosed.

BACKGROUND

Filter rods for use in the manufacture of filter cigarettes are manufactured by filter rod making machinery such as the KDF-2 filter maker from HAUNI MASCHINENBAU AG. In a filter rod making machine, cellulose acetate filter plug material, referred to as to tow, is drawn along a path from a source and subsequently compressed and paper wrapped in a garniture to form an elongate wrapped rod. The wrapped rod is subsequently cut to form individual rods made up of a number of filter rod segments each of which will eventually form the filter of an individual cigarette.

A filter cigarette can have an object within the filter, such as a breakable flavorant-containing capsule. Smoke from the cigarette may be selectively flavored by squeezing the filter, thereby breaking the capsule and releasing the flavorant. The breakable capsules are conventionally incorporated into smoking article filter rods by dispensing individual capsules one by one from a delivery wheel into a flow of tow as it passes through a filter rod making machine. Typical feed mechanisms for feeding objects, such as capsules, and for inserting them into filter rods are known from, for example, WO 2012/072676 A1 and WO2011/024105 A1.

Once the capsule containing filter rods have been manufactured, they are supplied to a cigarette manufacturing machine, which also receives rods of smokable material, such as tobacco rods, from a conventional tobacco rod maker. A typical cigarette manufacturing machine includes a rod attachment unit for attaching a filter rod and a tobacco rod together to form a filter cigarette. In a known filter attachment unit, a dual length filter rod (also called a "2-up" rod), which refers to a filter rod formed from two filter rod segments, is aligned with a tobacco rod at either end, and the three rods are wrapped with a wrapper known as "tipping paper" to join them together. The centrally positioned 2-up filter rod, together with its tipping paper wrapping, is then cut in half to form two filter cigarettes. The filter rods which are initially supplied to the cigarette manufacturing machine may also be a "4-up" filter rod, which refers to a filter rod that is formed from four filter rod segments. In this case, the 4-up filter rod is cut into a pair of dual length filter rods prior to attachment of a tobacco rod to both ends of each dual length filter rod. Suitable filter rod attachment units are machines such as the "MAX S" unit from HAUNI MASCHINENBAU, a "MAX 90" unit, also from HAUNI MASCHINENBAU, or a GD AF12 unit. Other suitable rod attachment units include the M5 or M8 filter tip attachment units from HAUNI MASCHINENBAU or the GD121 filter attachment unit.

The overall width of the tipping paper is greater than a length of the dual length filter rod so that, when the tipping paper is wrapped around the dual length filter rod, a portion of the tipping paper extends beyond the corresponding end of the dual length filter rod to wrap around a portion of the tobacco rod which is positioned coaxially with the dual length filter rod in abutting relation. Therefore, the tipping paper attaches a tobacco rod to each end of the dual length filter rod before the centrally positioned 2-up filter rod is cut in half to form two filter cigarettes.

Suitable filter rod attachment units are machines such as the "MAX S" unit from HAUNI MASCHINENBAU, a "Max 90" unit, also from HAUNI MASCHINENBAU, or a GD AF12 unit. Other suitable rod attachment units include the M5 or M8 filter tip attachment units from HAUNI MASCHINENBAU or the GD121 filter attachment unit.

BRIEF SUMMARY

In accordance with some embodiments described herein, there is provided a web of tipping paper for supplying a smoking article manufacturing machine which cuts the web into individual patches and wraps each patch about a respective dual length filter rod to attach rods of smokable material to the ends of each dual length filter rod, wherein a first lateral portion of the tipping paper web comprises a first longitudinal series of first indicators, and a second lateral portion of the tipping paper web comprises a second longitudinal series of second indicators, the first and second indicators being different to each other so that a first indicator is indicative of a first type of smoking article and a second indicator is indicative of a second type of smoking article which is different to the first type of smoking article, wherein the tipping paper web is configured to be loaded onto a smoking article manufacturing machine so that the machine wraps a first part of a patch of tipping paper which is formed from the first lateral portion of the tipping paper web around a first portion of the dual length filter rod in the formation of a smoking article of the first type and so that a first indicator on the first part of the patch denotes that said first portion of the dual length filter rod is part of a smoking article of the first type and, so that the machine wraps a second part of the patch which is formed from the second lateral portion of the tipping paper web around a second portion of the dual length filter rod in the formation of a smoking article of the second type and so that a second indicator on the second part of the patch denotes that said second portion of the dual length filter rod is part of a smoking article of the second type, prior to cutting the dual length filter rod and the patch into a first filter rod segment that is wrapped in said first part of the patch and which forms, together with the rod of smokable material attached thereto, a smoking article of the first type, and into a second filter rod segment that is wrapped in said second part of the patch and which forms, together with the rod of smokable material attached thereto, a smoking article of the second type.

Each indicator of the first longitudinal series of first indicators may be spaced from its longitudinally adjacent first indicator by a distance such that the first part of each patch has only one first indicator.

Additionally or alternatively, each indicator of the second longitudinal series of first indicators may be spaced from its longitudinally adjacent second indicator by a distance such that the second part of each patch has only one second indicator.

Each of said first and/or second indicators can comprise a visual or tactile mark or other indicia. All the first indicators of the first longitudinal series can be the same, and all the second indicators of the second longitudinal series can be the same. However, the first indicators of the first series are different to the second indicators of the second series.

In accordance with another embodiment described herein, there is provided a bobbin configured to be mounted to a tipping unit of a smoking article manufacturing machine and a web of tipping paper, according to the disclosure, wound on the bobbin.

A method of using the tipping paper web, according to the disclosure, in the concurrent manufacture of two different types of smoking article on a smoking article manufacturing machine that comprises a filter rod feeder, a rod attachment unit for attaching rods of smokable material to each longitudinal end of a dual length filter rod received from the filter rod feeder, and a cutter to cut the dual length filter rod into two filter rod segments so that each segment, together with the rod of smokable material attached to each segment, relates to a different respective smoking article, the method comprising threading the web of tipping paper through the smoking article manufacturing machine so that, during operation, the web is cut into individual patches before wrapping each patch about a respective dual length filter rod to attach rods of smokable material to the ends of each dual length filter rod, and so that a first part of a patch formed from a first lateral portion of the tipping paper web is wrapped around a first portion of the dual length filter rod in the formation of a smoking article of the first type such that a first indicator on the first part of the patch denotes that said first portion of the dual length filter rod is part of a smoking article of the first type, and so that a second part of the patch formed from a second lateral portion of the tipping paper web is wrapped around a second portion of the dual length filter rod in the formation of a smoking article of the second type such that a second indicator on the second part of the patch denotes that said second portion of the dual length filter rod is a smoking article of the second type, prior to cutting the dual length filter rod and the patch into a first filter rod segment that is wrapped in said first part of the patch and which forms, together with the rod of smokable material attached thereto, a smoking article of the first type, and into a second filter rod segment that is wrapped in said second part of the patch and which forms, together with the rod of smokable material attached thereto, a smoking article of the second type.

BRIEF DESCRIPTION OF THE DRAWINGS

In order that the disclosure may be more fully understood, embodiments thereof will now be described, by way of example only, with reference to the accompanying drawings, in which.

DETAILED DESCRIPTION

Figure 1:
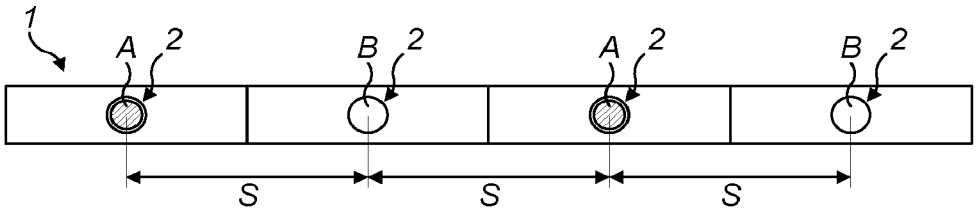
FIG. 1 is a side elevation of a 4-up capsule-containing filter rod which is supplied to a cigarette manufacturing machine, which is also supplied with a web of tipping paper according to an embodiment of the disclosure.

To simultaneously manufacture two different types of smoking article in a filter attachment cigarette manufacturing machine 17 (see FIG. 10), a filter rod feeder 22 of the cigarette manufacturing machine 17 is supplied with pre-oriented rod articles, namely 4-up filter rods 1 (see FIG. 1), each of which contains four equally spaced capsules 2 comprising two capsules of a first type "A" and two capsules of a second type "B". The capsules 2 are inserted into the filter rods 1 by a conventional capsule inserter filter rod making machine 5 (see FIG. 5) and so that they are spaced relatively far apart, i.e. so that the separation "S" between centers of adjacent capsules is approximately 27 mm.

Figure 2:
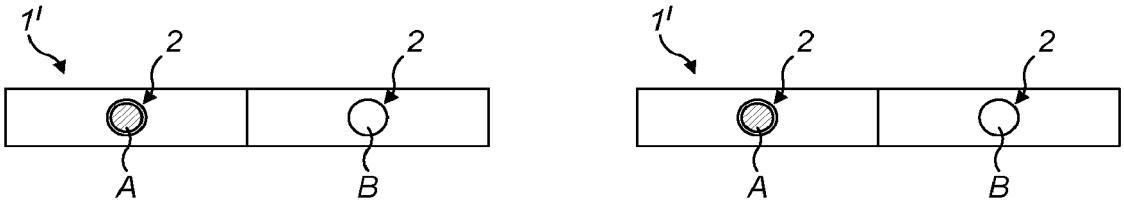
FIG. 2 is a side elevation of the filter rod shown in FIG. 1, after it has been cut centrally to form a pair of dual length filter rods.
Figure 3:
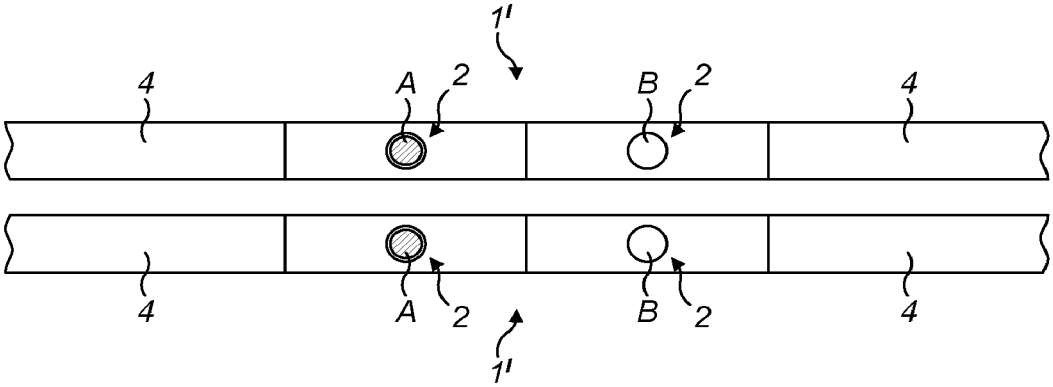
FIG. 3 is a side elevation of each of the dual length filter rods shown in FIG. 2, after a tobacco rod has been attached to the ends of each dual length filter rod using tipping paper.
Figure 4:
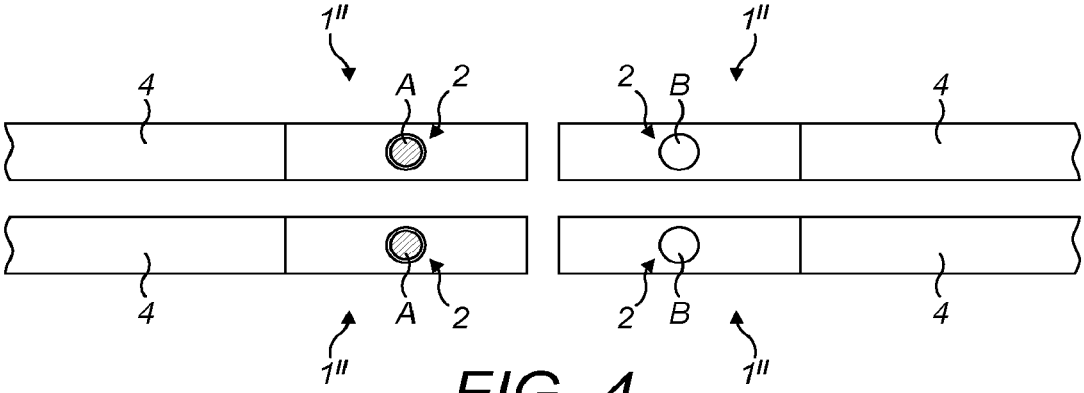
FIG. 4 is the same view of the dual length filter rods and tobacco rods as shown in FIG. 3, but after each dual length filter rod has been centrally cut to form a pair of filter rod segments, each segment being associated with its own tobacco rod to form an individual cigarette.

The capsules 2 are provided along the length of the filter rod 1 in an alternating manner so that capsules 2 of identical type are not adjacent to each other, i.e. they may be in the order A-B-A-B. A cutting drum 23*a* and knife drum 29*a* of the filter attachment cigarette manufacturing machine 17 cooperate with each other to initially cut the 4-up filter rod in half to form an identical pair of 2-up or dual length filter rods 1', as shown in FIG. 2, prior to the attachment of a rod of smokable material, such as a tobacco rod 4 to both ends of each dual length filter rod 1', as shown in FIG. 3 (only part of each of the tobacco rods 4 being shown in FIG. 3) to form adjoined cigarettes, one of which is referred to as an "internal" cigarette and the other an "external" cigarette. As the initial 4-up filter rod 1 contains capsules 2 in an alternating configuration, each dual length filter rod 1' will contain one capsule 2 of type 'A' and one of type 'B' in the sequence 'A'-'B' as shown in FIG. 2. To attach a tobacco rod 4 to the ends of each dual length filter rod 1', the dual length filter rods 1' and tobacco rods 4 are fed through a filter attachment unit of the cigarette manufacturing machine 17 in which the tobacco rods 4 are attached to the ends of each dual length filter rod 1' using tipping paper. Finally, as shown in FIG. 4, each of the dual length filter rods 1' are cut in half to form two filter rod segments 1", each segment being attached to its associated tobacco rod 4 to form an individual cigarette. As the cigarettes formed from the same dual filter rod 1' have a different type of capsule 2 within their respective filter rod segments 1", two different types of cigarette are produced, one with a filter containing a capsule 2 of type "A" and one with a filter containing a capsule 2 of type "B".

The four filter cigarettes produced from the original 4-up filter rod 1 will include two cigarettes of one type, as their filter segments 1" contain capsules of type A, and two cigarettes of another type, as their filter segments 1" contain capsules of type B. All of the cigarettes will have the same type of tobacco rod 4 and the same type of filter, apart from the different type of capsule 2 contained within their filter rod segments 1".

Although the rod article supplied to the filter attachment cigarette manufacturing machine 17 is preferably a 4-up filter rod 1 as shown in FIG. 1, which is initially cut to form a pair of 2-up or dual length filter rods 1' by the cutter drum 23*a*, the rod article supplied to the filter attachment cigarette manufacturing machine 17 may alternatively be a 2-up or dual filter rod 1', i.e. a 4-up filter rod which has already been cut into a dual filter rod 1' pair. In this instance, each dual filter rod 1' will contain one capsule 2 of each type, i.e., 'A'-'B', and the initial cutting by the cigarette manufacturing machine 17 prior to attachment of a tobacco rod 4 to the ends of each dual filter rod 1' is not necessary. The rod article supplied to the filter attachment cigarette manufacturing machine 17 may alternatively be a 6-up filter rod. In this case, the 6-up filter rod is initially cut into three 2-up dual length filter rods 1' by the cutter drum 23*a*, each dual length filter rod 1' containing one capsule 2 of each type 'A' and 'B', prior to attachment to the ends of each of the three dual length filter rods 1'.

The technology for manufacturing filter rods 1 containing capsules 2 is known in the art and reference is made to WO2012/072676 and WO2011/024105, both of which are incorporated herein by reference.

Figure 5:
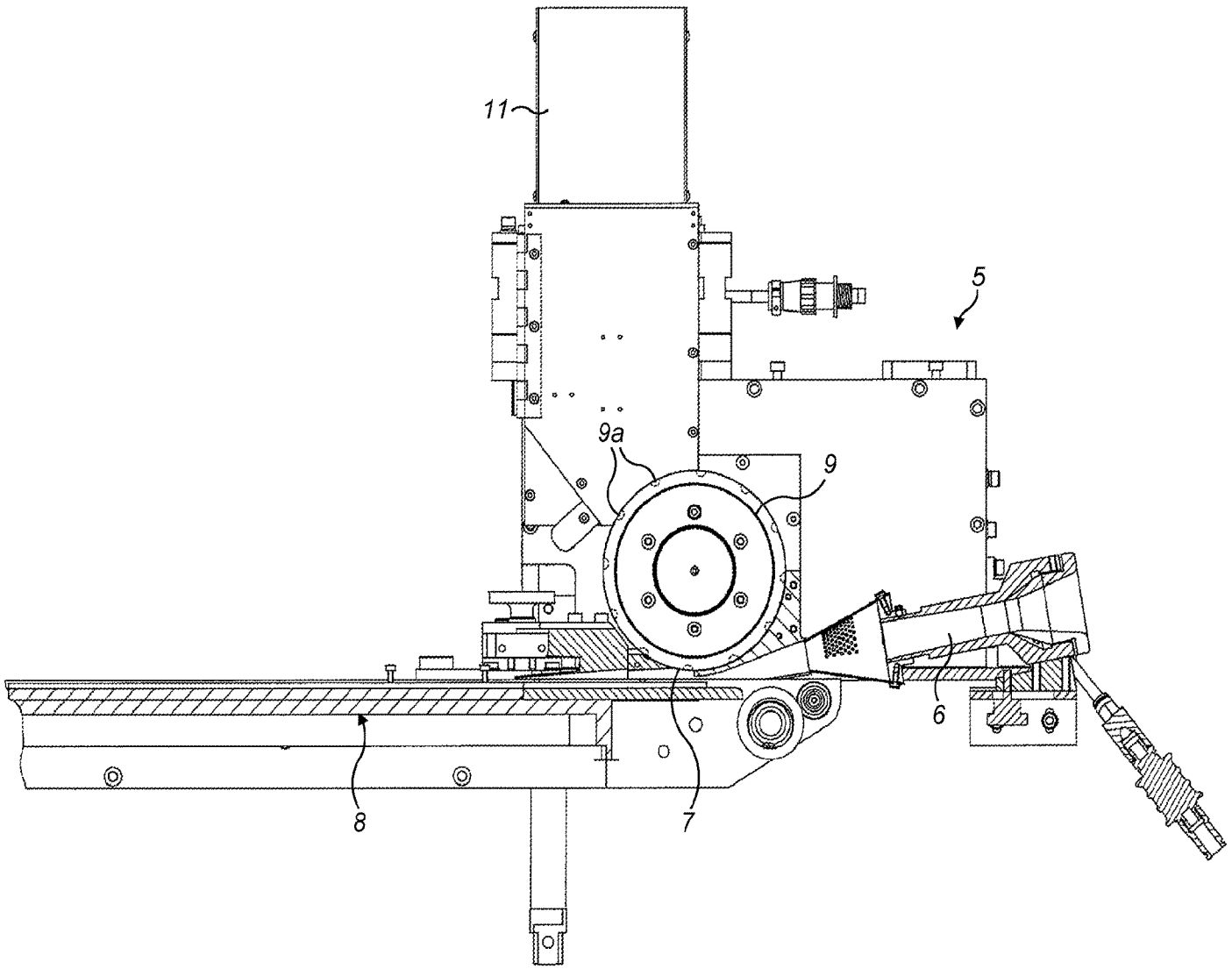
FIG. 5 is a cross-sectional view of a conventional filter rod making machine and capsule inserter unit.
Figure 7:
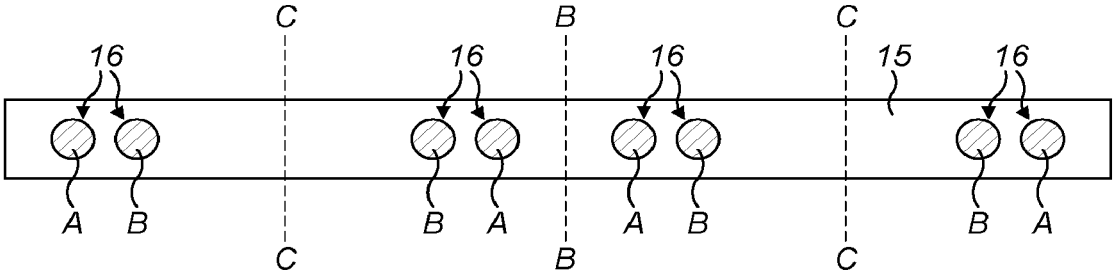
FIG. 7 is a representation of a 4-up filter rod that can be produced using the feed mechanism of FIGS. 6A and 6B.

FIG. 5 is a cross-sectional view of a filter rod making machine and capsule inserter unit 5, known from WO2011/024105. In operation, filter plug material (not shown) in the form of cellulose acetate filter tow is drawn from a source, stretched in a set of stretching rollers (not shown) and compressed through a stuffer jet 6 and drawn through the tongue 7 of garniture 8. As shown, the machine 5 has a rotatable capsule inserter wheel 9 arranged to insert capsules 2 from circumferential recesses 9*a* directly into the tongue 7 so that the capsules 2 come into contact with filter tow passing therethrough. As described in WO2011/024105, the machine 5 can be adjusted to control the distance between the centers of adjacent capsules 2. The tow is wrapped in plug wrap 10 (see FIG. 7) in the garniture 8 to form an elongate rod which is subsequently cut to a desired length (such as the length of the filter rod 1, equivalent to four filter rod segments 1", as shown in FIG. 1), for placement of the manufactured filter rods 1 into the filter rod feeder 22 of the cigarette manufacturing machine 17.

WO2011/024105 does not describe an arrangement in which different types of capsules 2 are inserted into the same elongate filter rod 1. Whilst it is possible to place capsules 2 of different types together in the capsule hopper 11 of the apparatus known from WO2011/024105, this would result in capsules 2 being delivered into the tow in an entirely random sequence.

Figure 6A:
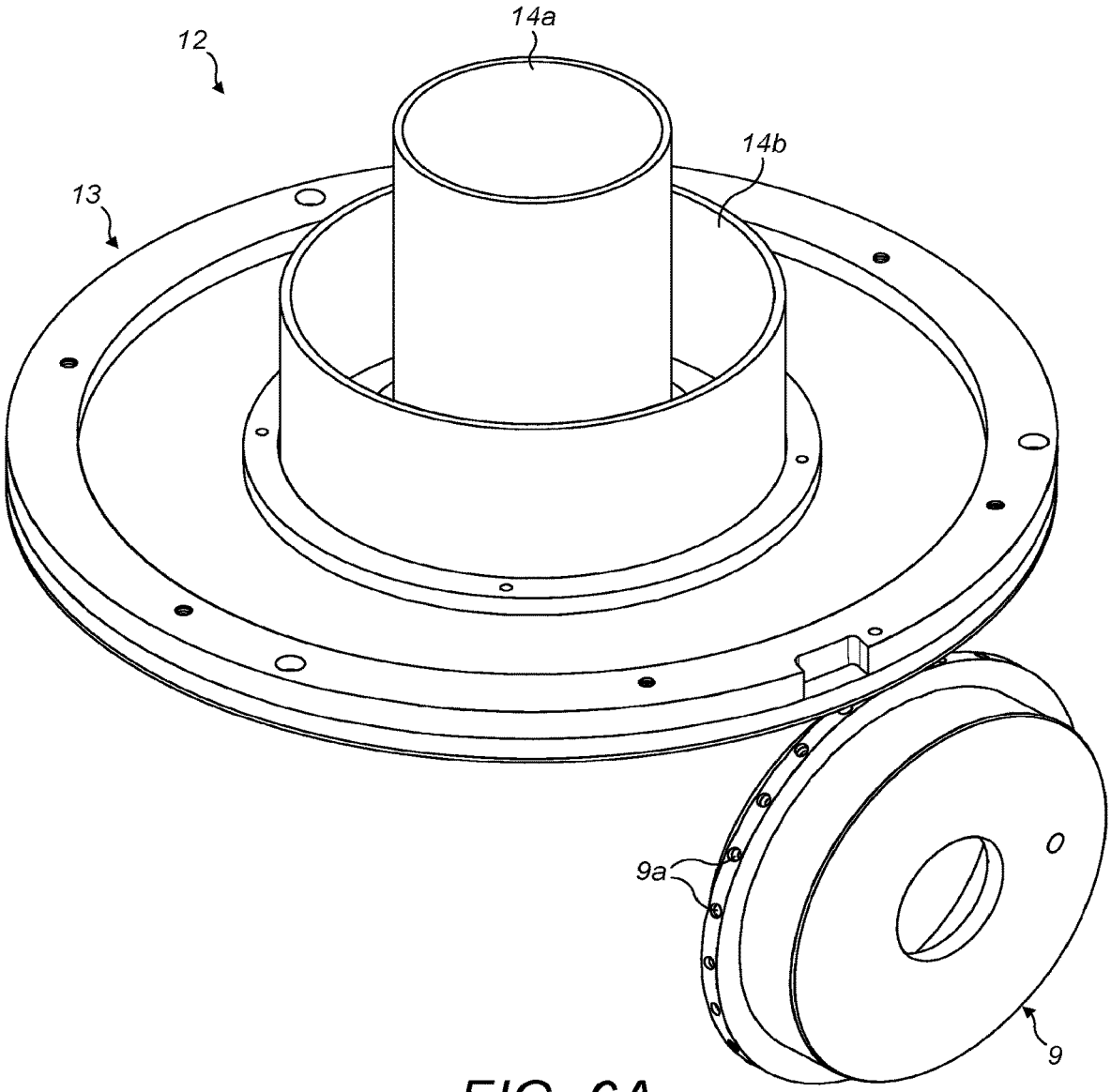
FIG. 6A shows a conventional capsule feed mechanism.
Figure 6B:
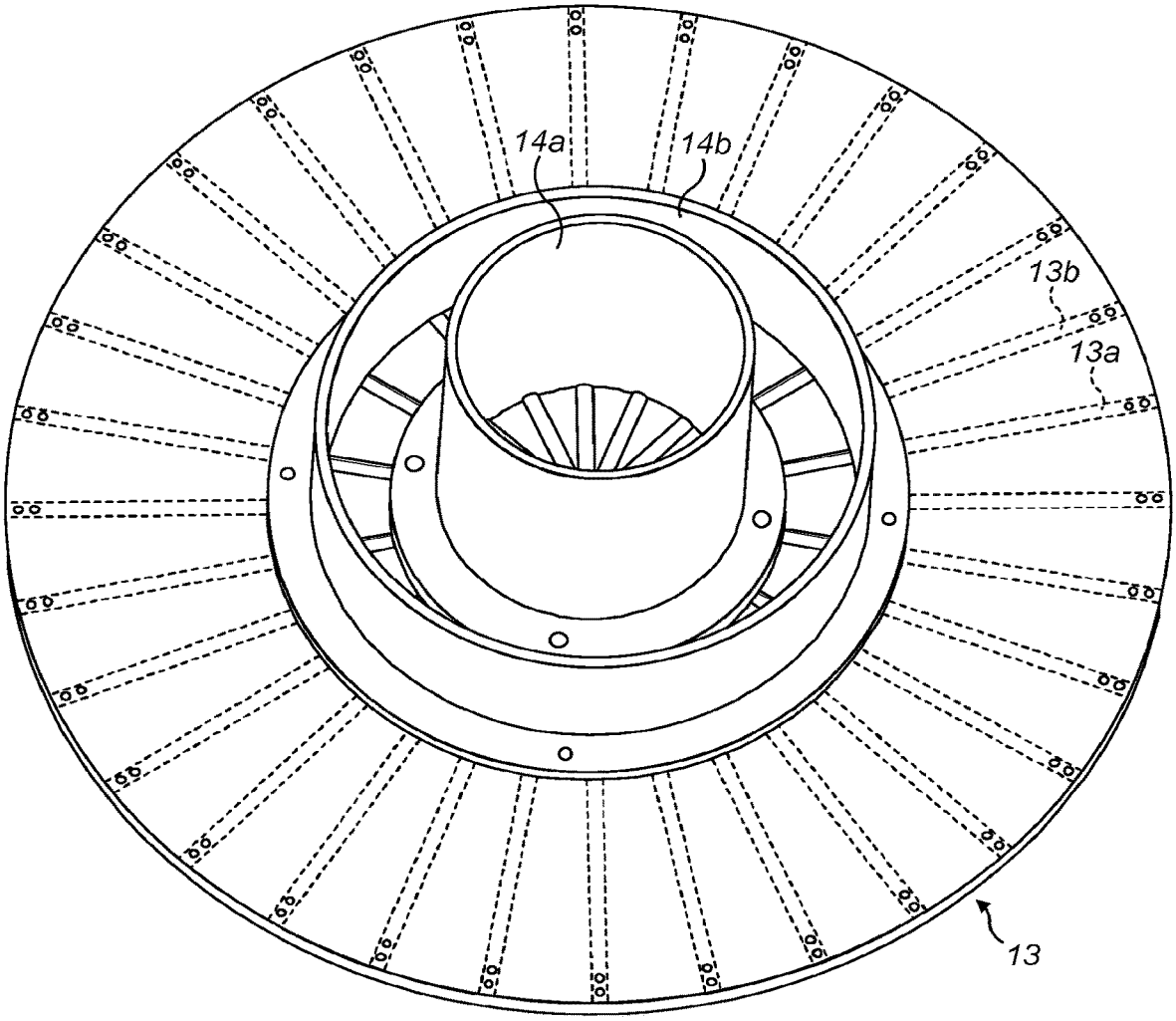
FIG. 6B shows a top view of the rotary feed disk of the feed mechanism of FIG. 6A.

FIGS. 6A and 6B shows a capsule feed mechanism 12 from WO2012/072676. The feed mechanism 12 has a rotatable disk assembly 13 for feeding capsules 2 into pockets 9*a* of a rotatable capsule inserter wheel 9, similar to the rotatable capsule inserter wheel 9 referred to above in relation to WO2011/024105. The disk assembly 13 has two sets of channels 13*a*,13*b* (see FIG. 6B) for guiding capsules 2 respectively received in first and second capsule inputs 14*a*,14*b*. The channels 13*a*, 13*b* are alternately positioned around the disk assembly 13. Consequently, capsules 2 from the first and second inputs 14*a*, 14*b* are alternately delivered into the pockets 9*a* of the rotatable capsule inserter wheel 9 via respective channel sets 13*a*,13*b*, and so are inserted alternately into the tow. By placing capsules 2 of one type 'A' in the first input 14*a* and capsules 2 of a second type 'B' in the second input 14*b*, pairs of capsules 2, in which the individual capsules 2 of each pair are of a different type 'A'-'B', can be inserted into the tow. By altering the angular separation between channels 13*a*, 13*b* and by spacing the pockets 9*a* in the rotatable capsule inserter wheel 9 in a corresponding manner, capsules 2 may be inserted from the rotatable capsule inserter wheel 9 into the tow with varying intervals between successive deliveries, so that any desired longitudinal arrangement of capsules 2 can be obtained in the eventual filter rods 1.

In the device known from WO2012/072676, an embodiment is described in which the eventual filter rod 15 contains four capsules 16 of one type (type 'A') and four capsules 16 of another type (type 'B'), arranged in the sequence 'A'-'B'-'B'-'A'-'A'-'B'-'B'-'A' along the length of the filter rod 15. The eight capsules 16 may be arranged in four pairs, the separation between capsules 16 in neighboring pairs being greater than the separation between neighboring capsules 16 in a pair as, for example, shown in the exemplary filter rod 15 of FIG. 7. The separation between neighboring capsules 16 in each pair is 11 mm. In cigarette manufacture, the filter rod 15 is initially cut into dual length filter rods 1' along line 'B'-'B', and a tobacco rod 4 is attached to the ends of each dual filter rod before the dual filter rods 1' are cut, along lines 'C'-'C' into filter rod segments 1" each of which is associated with its own tobacco rod 4 to form a cigarette. Each filter rod segment 1" contains two capsules 16, each of which is of a different type. It will be appreciated that the cigarettes manufactured in this way are all identical, i.e. each filter rod segment 1" has a capsule of type 'A' closest to the mouth end of the cigarette and a capsule of type 'B' furthest from the mouth end. It will be appreciated that the disk assembly 13 of FIGS. 6A and 6B can be used to insert individually spaced capsules 2, rather than pairs of capsules 2, into the tow.

Whilst WO2011/024105 and WO2012/072676 both disclose technology for inserting objects into filter rods, and WO2012/072676 further discloses embodiments in which a sequence of two different types 'A' and 'B' of capsules 16 can be inserted into the same filter rod 15, it will be appreciated that the filter rods 1 produced by this machine 5 are cut by a filter attachment cigarette manufacturing machine 17 to form identical filter rod segments 1", each containing the same capsule 2 or same pair of capsules 16. If the capsules 16 are in pairs, the sequence of capsule types 'A' and 'B' within each pair is also the same. Therefore, all the cigarettes manufactured using the filter rod segments 1" are identical.

Two different types of cigarette can be simultaneously produced in a cigarette manufacturing machine 17. This is achieved by supplying the machine 17 with filter rods 1 containing capsules 2 of different types in which the capsules 2 are longitudinally separated from each other by a distance 'S' (see FIG. 1), such that when the filter rod 1 is initially cut into a dual length filter rod 1', that dual length filter rod 1' will contain one capsule 2 of each type, i.e. one capsule 2 of type 'A' and one capsule 2 of type 'B' and, when the dual length filter rod 1' is cut to form two filter rod segments 1", each segment 1" will contain one of those capsules 2. As each segment 1" is associated with a tobacco rod 4 and the segment 1" and tobacco rod 4 together form a cigarette, it will be appreciated that each dual filter rod 1' forms two different types of cigarette, i.e. cigarettes in which the filter rod segment 1" of each cigarette contains a capsule 2 of a different type.

Figure 8:
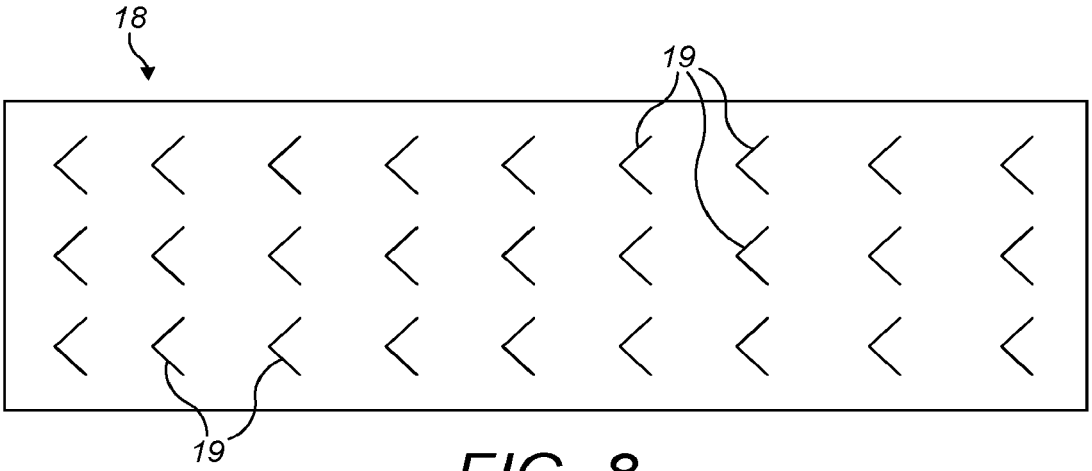
FIG. 8 shows a plug wrap with indicators to indicate its orientation and which can be used in in an embodiment of the method of the disclosure.

The plug wrap 18 which is wrapped around each filter rod 1 by the filter rod making machine 5 may be provided with indicators or other visual or tactile indicia 19 to provide an indication as to the orientation of the filter rods 1, i.e. at which end of the filter rod 1 has a capsule 2 of type 'A', as opposed to a type 'B' capsule 2, situated at the other end of the filter rod 1. A visual representation of how a section of plug wrap 18 may look is shown in FIG. 8. In this embodiment, chevrons 19 are printed onto the plug wrap 18, all of which are in the same orientation to denote a particular end of the filter rod 1 about which it is wrapped by the filter rod making machine 5. For example, the chevrons 19 may act as arrow heads to indicate the end of the filter rod 1 that has a capsule 2 of type 'A' inserted into it. It will be appreciated any type of indicator or indica 19 may be applied to the plug wrap 18 and that it may be visual or tactile in nature, so that it signifies one end of the plug wrap relative to the other end.

An operator loads a bobbin, on which a supply of plug wrap 18 is wound, onto the filter rod making machine 5, in such a way that the indicators 19 on it correctly denote, when cut into filter rods 1, which end of the filter rod 1 is which, i.e. which end of the filter rod 1 has a capsule 2 of type 'A' in it as opposed to a capsule of type 'B'. This indication will then ensure that the operator manually places the filter rods 1 in the filter rod feeder 22 of the cigarette manufacturing machine 17 in the correct orientation in a subsequent manufacturing step.

By placing the filter rods 1 in the filter rod feeder 22 of a cigarette manufacturing machine 17 in the correct orientation, as a result of knowing which end of the filter rod 1 contains a capsule of type 'A', and which end contains a capsule 2 of type 'B', and by providing tipping paper according to an embodiment of the disclosure with indicators to denote to consumers the type of capsule 2 contained within a particular filter, it is possible to ensure that the end of a dual length filter rod 1' containing a capsule 2 of type 'A' is are wrapped with that part of the tipping paper according to an embodiment of the disclosure which carries an indicator corresponding to capsule type 'A' and, that the other end of the dual length filter rod 1' containing a capsule 2 of type 'B' is wrapped with the remaining part of the tipping paper according to an embodiment of the disclosure which carries an indicator corresponding to capsule type 'B'. A respective capsule type-denoting indicator on the tipping paper will then be in register or correspond with the type of capsule 2 contained within that part of the dual length filter rod 1' about which it is wrapped, so a consumer will be able to correctly identify a cigarette as being of a particular type, i.e. whether it is a smoking article having a filter containing a capsule of type 'A' or type 'B'.

As described in more detail below, the indicator on the tipping paper according to the disclosure may be a mark, printed indicia or any other visual type of indicator. It will also be appreciated that the indicator could be non-visual, for example, they could be tactile in nature.

Figure 10:
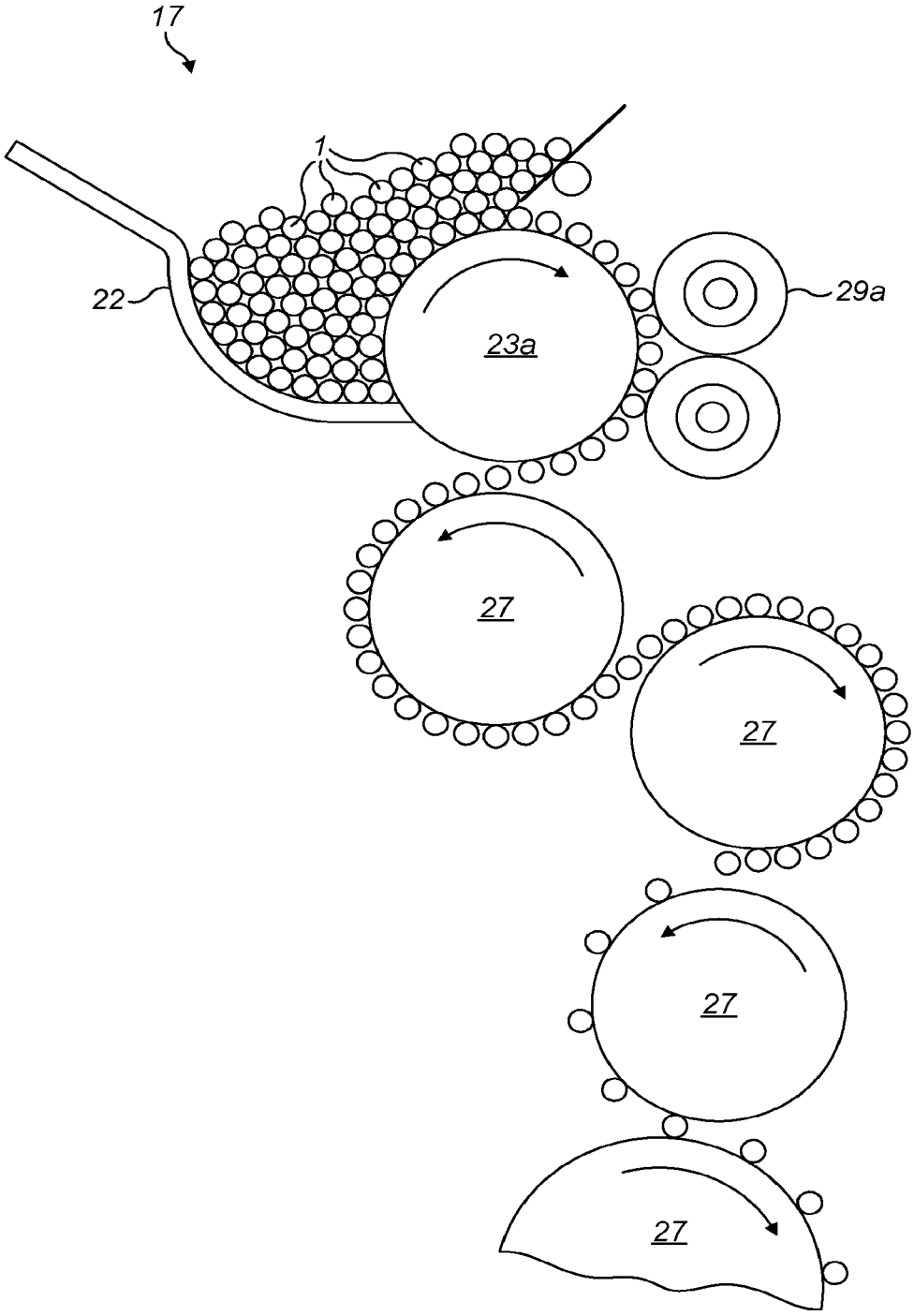
FIG. 10 is a schematic side elevation of a conventional cigarette manufacturing machine.
Figure 11:
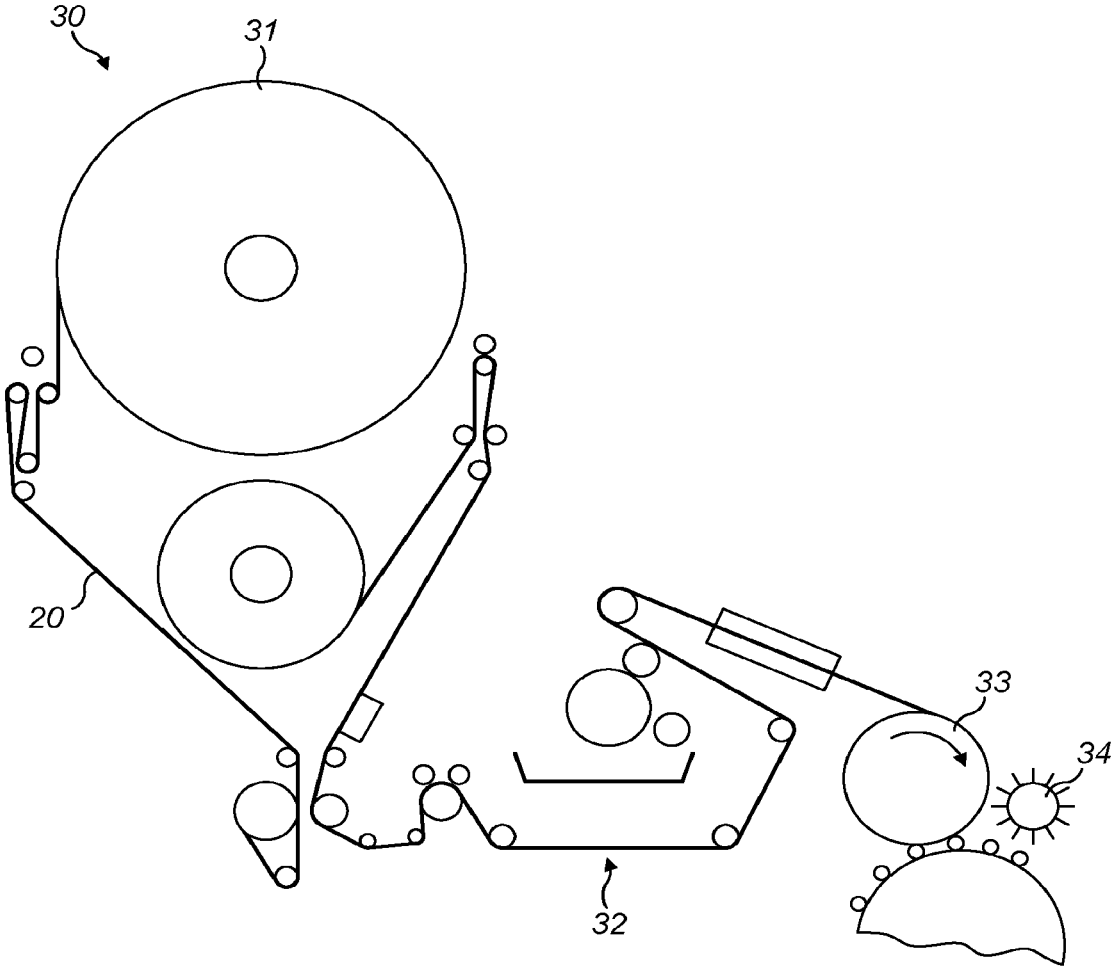
FIG. 11 is a side elevation of a tipping unit to receive a bobbin on which a web of tipping paper according to the disclosure has been wound.

A cigarette manufacturing machine 17, as shown in general in FIG. 10, comprises a tipping unit 30, as shown in FIG. 11. The tipping unit 30 receives a rotatably mounted bobbin 31 on which a web of tipping paper 20 is wound. As the tipping paper 20 is unwound from the bobbin 30, it passes over a series of rollers and through a glue applicator unit 32 before being passed around a drum 33 so that a knife drum 34 cuts the web into individual tipping paper patches which are then attached to dual length filter rods 1', and their associated tobacco rods 4, on one of the drums 27 of the filter attachment unit.

Figure 9:
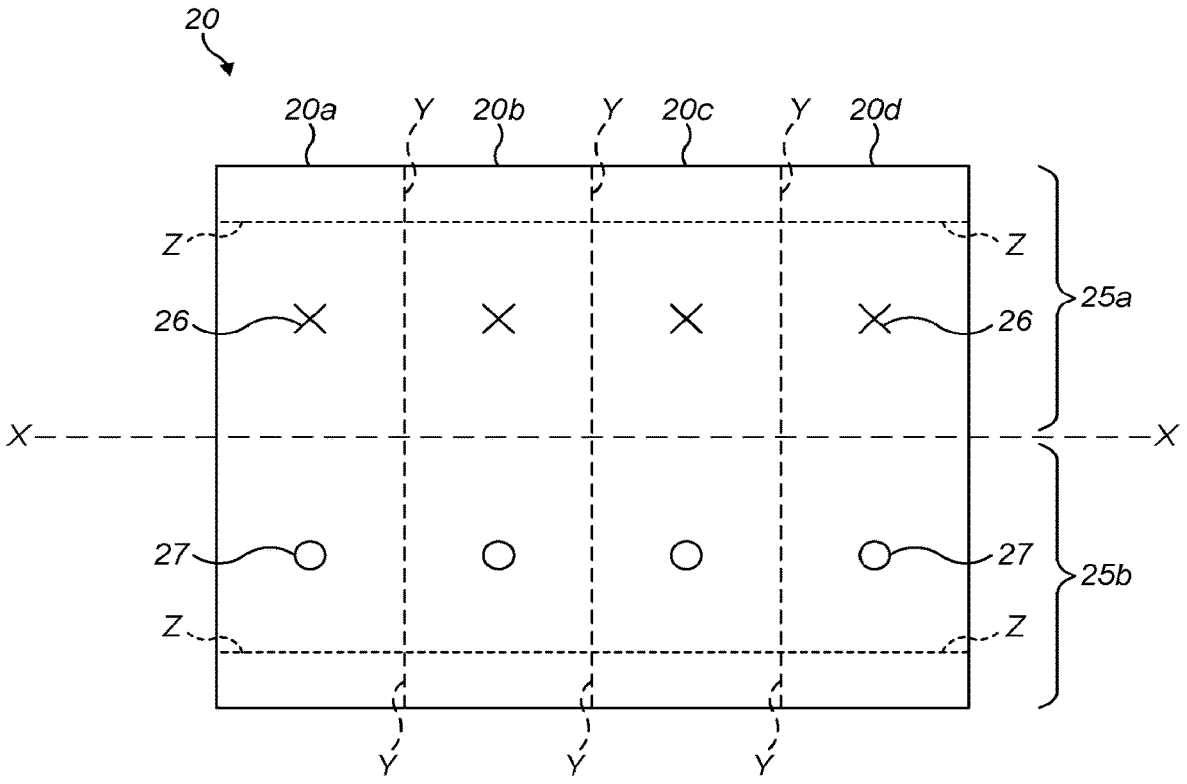
FIG. 9 shows a tipping paper according to an embodiment of the present disclosure, with two sets of lateral indicators to indicate the type of capsule contained within the filter about which the tipping paper is wrapped.

A length of tipping paper 20, as shown in FIG. 9, is divided into four tipping paper sections or patches 20*a*,20*b*, 20*c*, 20*d*, in which each patch is suitable for wrapping around a dual length filter rod 1' when cut by a tipping unit into individual patches along lines Y-Y. Each patch 20*a*,20*b*, 20*c*,20*d* comprises a first part formed from a first lateral portion 25*a* of the length of tipping paper 20 and, second part formed from a second lateral portion 25*b* of the length of tipping paper 20. The tipping paper 20 comprises a first longitudinal series of first indicators 26 on the first lateral portion 25*a*, and a second longitudinal series of second indicators 27 on the second lateral portion 25*b*. The first indicators 26 are longitudinally spaced so that one first indicator appears on the first part of each patch 20*a*, 20*b*, 20*c*, 20*d*. Similarly, the second indicators 27 are longitudinally spaced so that one second indicator appears on the second part of each patch 20*a*, 20*b*, 20*c*, 20*d*. The first and second indicators 26,27 are different to each other and correspond to or denote first and second capsule types A and B, respectively, of the capsules 2 received in the filter rod segments 1". The first and second lateral portions 25*a*, 25*b* are divided by an imaginary center line X-X extending the length of the tipping paper 20 and which separates each patch 20*a*,20*b*,20*c*,20*d* into its first and second parts.

The filter rods 1 are placed in the filter rod feeder 22 in an orientation that corresponds to, or is in register with, an orientation of the tipping paper supply mounted in the tipping unit 30, and so that a part of a patch formed from the first lateral portion 25*a* of the tipping paper, and which carries a first indicator 26 corresponding to capsule type 'A', will be wrapped around a portion of the dual length filter rod 1' containing a capsule 2 of the first type 'A' and, a part of the patch formed from the second lateral portion 25*b*, and which carries a second indicator 27 corresponding to capsule type 'B', will become wrapped around a portion of the filter rod 1' containing a capsule 2 of the second type B, when the dual length filter rods 1' and tobacco rods 4 are attached to each other. Each of the first and second indicators on the tipping paper will be recognizable to a consumer as representing a particular capsule type 'A' or 'B' and any combination of, for example, colors, words, symbols, ridges, indents or embossing may be used for this purpose. For ease of illustration and description only, the indicators in FIG. 9, are represented by 'X' and 'O', where indicator 'X' would be a first of indicator known to a consumer as representing a capsule 2 of type 'A' and indicator 'O' would be a second indicator of a different appearance, kind or style and which is known to a consumer as representing a capsule 2 of type 'B'. The first part of a patch formed from a first lateral portion 25*a* of the tipping paper 20 is wrapped around the part of the dual length filter rod 1' containing a capsule of type 'A', and the second part of a patch formed from a second lateral portion 25*b* of the tipping paper 20 is wrapped around the part of the dual length filter rod 1' containing a capsule of type 'B', so that a consumer can identify the type of capsule 2 contained in a filter rod segment 1" from the first and indicators 26,27 on the tipping paper 20 wrapped around it.

The width of the tipping paper 20 is greater than the length of each dual length filter rod 1' so that an edge region of each lateral portion of the tipping paper 20 extends beyond corresponding ends of the dual length filter rod 1' and over a part of the tobacco rod 4 in order to attach the tobacco rod 4 to the dual length filter rod 1'. A dotted line Z-Z represents the extent of the tipping paper 20 that extends over the dual length filter rod 1' so that the part beyond each dotted line Z-Z is an edge region extending over a corresponding tobacco rod 4.

As the filter attachment cigarette manufacturing machine 17 which is supplied with elongate filter rods 1 is of a known type to those skilled in the art, it will not be described herein in detail. However, it will be appreciated that a filter attachment cigarette manufacturing machine 17 receives the filter rods 1 from the filter rod feeder 22, in which they have been placed by an automated pneumatic transport from the filter rod production department, and also receives tobacco rods 4 from a tobacco rod maker (not shown), and conveys them through a filter attachment unit by a plurality of cylindrical drums 27. Rod articles are passed from drum to drum as they are conveyed through the unit. The drums have a plurality of grooves for holding rod articles during transport, the grooves being spaced around the curved periphery of a drum, with each groove extending in the direction of the drum axis.

Certain drums are configured so that particular operations are carried out as the rod articles are conveyed by the drums 27. For example known filter attachment machines include a swash plate drum for longitudinally compressing two tobacco rods and a 2-up filter rod before tipping paper patches are applied, and a rolling drum which co-operates with a roll hand to wrap a tipping paper patch around the three rods. Other known drums include cutting drums, such as cutting drum 23*a* and knife drum 29*a* to cut rod articles, separating drums for separating rod articles, inspection drums to inspect for the presence of filters or to carry out a leakage test, laser drums to burn small perforations in filter rods, and turning drums to change the orientation of cigarettes. Other known drums include transfer drums (also referred to as "intermediate drums"), takeover drums and feed drums. As mentioned above, a known cigarette manufacturing machine includes a tipping unit 30 for supplying tipping paper 20 and a glue unit 32 for applying glue to the tipping paper 20.

Suitable filter rod feeders 22 for feeding filter rods 1 into the cigarette manufacturing machine 17 are "Max S", "Max 90" or GD121 machines. As shown in FIG. 10, the filter rod feeder 22 receives 4-up filter rods 1 and feeds them onto the drums 27. The filter rod feeder 22 includes a cutting drum 23*a* that cooperates with a knife drum 29*a* to cut each 4-up filter rod 1 placed in the filter rod feeder 22 by an operator into two 2-up rods prior to each 2-up rod being fed onto the feed drums 27.

The objects which are inserted into the filter rods 1 by the filter rod manufacturing machine 3 are preferably capsules 2. Each capsule 2 is preferably spherical, formed from gelatin and has an interior volume filled with flavorant. As used herein, the term "flavorant" refers to materials which, where local regulations permit, may be used to create a desired taste or aroma in a product for adult consumers. They may include extracts (e.g., licorice, hydrangea, Japanese white bark magnolia leaf, chamomile, fenugreek, clove, menthol, Japanese mint, aniseed, cinnamon, herb, wintergreen, cherry, berry, peach, apple, Drambuie, bourbon, scotch, whiskey, spearmint, peppermint, lavender, cardamom, celery, cascarilla, nutmeg, sandalwood, bergamot, geranium, honey essence, rose oil, vanilla, lemon oil, orange oil, cassia, caraway, cognac, jasmine, ylang-ylang, sage, fennel, piment, ginger, anise, coriander, coffee, or a mint oil from any species of the genus Mentha), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, oil, liquid, or powder. Capsule types 'A' and 'B' are differentiated from each other by their content. In particular, capsule type 'A' will contain one of the flavorants listed above, whereas capsule type 'B' will contain a different one of the flavorants listed above.

The capsules may have a diameter of 3.5 mm. It will be appreciated that other objects suitable for insertion into filter rods 1 could alternatively or additionally be fed by the filter rod manufacturing machine 5, such as pellets or pieces of charcoal. In particular, one of the capsule types 'A' or 'B' could be replaced by a pellet or piece of charcoal, so that one of the filter rod segments 1" formed from a dual length filter rod 1' contains a capsule 2 and the other contains a pellet or piece of charcoal.

Although reference is made to one of the segments cut from a dual length filter rod as containing a capsule of type 'A' and the other segment containing a capsule of type 'B', it will be appreciated that there may be more than one capsule or object in one segment or in each of the segments, each capsule or object in one segment can be of the same or of a different type. It is the fact that the segments formed from the same dual length filter rod are different to each other, in terms of the object type or quantity of objects received within each them, which is of importance, as it is this which results in the smoking articles formed from the same dual length filter rod 1' as being of different types.

Whilst embodiments of the disclosure have been described with reference to the difference between smoking articles as being as a result of different objects or combination of objects inserted into filter rod segments formed from the same dual length filter rod, it will be appreciated that the tipping paper of the embodiments of the disclosure could be used to identify two cigarettes formed from the same dual length filter rod that differ in ways other than the type of object inserted into the filter. For example, each cigarette may have a different tobacco rod.

The various embodiments described herein are presented only to assist in understanding and teaching the claimed features. These embodiments are provided as a representative sample of embodiments only, and are not exhaustive and/or exclusive. It is to be understood that advantages, embodiments, examples, functions, features, structures, and/or other aspects described herein are not to be considered limitations on the scope of the disclosure as defined by the claims or limitations on equivalents to the claims, and that other embodiments may be utilized and modifications may be made without departing from the scope of the claimed disclosure. Various embodiments of the disclosure may suitably comprise, consist of, or consist essentially of, appropriate combinations of the disclosed elements, components, features, parts, steps, means, etc., other than those specifically described herein. In addition, this disclosure may include other disclosures not presently claimed, but which may be claimed in future.

The invention claimed is:

1. A method of manufacturing smoking articles in a smoking article manufacturing machine, comprising:

supplying the smoking article manufacturing machine with dual length filter rods, each dual length filter rod containing a capsule of a first type and a capsule of a second type;

using the smoking article manufacturing machine to cut patches of tipping paper from a web of tipping paper;

using the smoking article manufacturing machine to wrap one of said patches of tipping paper about each dual length filter rod to attach a rod of smokable material to opposite ends thereof;

using the smoking article manufacturing machine to cut each wrapped dual length filter rod to form a first and a second smoking article, the first smoking article comprising a first filter rod segment formed from the dual length filter rod and the second smoking article comprising a second filter rod segment formed from the dual length filter rod, and in which the first filter rod segment comprises the first type of capsule and the second filter rod segment comprises the second type of capsule;

wherein the web of tipping paper comprises a first lateral portion and a second lateral portion, the first lateral portion having different visual or tactile mark or indicia to the second lateral portion, wherein the step of using the smoking article manufacturing machine to cut patches of tipping paper from said web of tipping paper comprises using it to cut the tipping paper such that each patch includes a section of said first lateral portion and a section of said second lateral portion, and wherein the step of using the smoking article manufacturing machine to wrap one patch of tipping paper about each dual length filter rod comprises using it to wrap the dual length filter rod such that the section of the first lateral portion of the patch is wrapped about a part of the dual length filter rod to be cut to form the first filter rod segment, and the section of the second lateral portion is wrapped about a part of the dual length filter rod to be cut to form the second filter rod segment, so that a smoking article comprising a first filter rod segment containing a first type of capsule wrapped in the section of the first lateral portion of the patch is distinguishable from a smoking article comprising a second filter rod segment containing a second type of capsule wrapped in the section of the second lateral portion of the patch, due to the visual or tactile mark or indicia on the section of the first lateral portion being different to the visual or tactile mark or indicia on the section of the second lateral portion.

* * * * *